US005961376A

United States Patent [19]

Gottschald

[11] Patent Number: 5,961,376

[45] Date of Patent: Oct. 5, 1999

[54] METHOD OF INCREASING THE SERVICE LIFE OF GRINDING WHEELS

[75] Inventor: Lutz Gottschald, Meerbusch, Germany

[73] Assignee: Wernicke & Co. GmbH, Germany

[21] Appl. No.: 09/008,168

[22] Filed: Jan. 16, 1998

[30] Foreign Application Priority Data

Jan. 16, 1997 [DE] Germany ..... 197 01 287

[51] Int. Cl.[6] ..... B24B 1/00

[52] U.S. Cl. ..... 451/43; 451/53; 451/56

[58] Field of Search ..... 451/43, 53, 56, 451/72, 443

[56] References Cited

U.S. PATENT DOCUMENTS

| | | | |
|---|---|---|---|
| Re. 24,448 | 4/1958 | Flanders | 451/56 |
| 2,426,817 | 9/1947 | Charlton et al. | 451/53 |
| 3,167,893 | 2/1965 | Giardini et al. . | |
| 3,244,162 | 4/1966 | Rademacher . | |
| 3,922,821 | 12/1975 | Canterbury | 451/53 X |
| 4,109,422 | 8/1978 | Parsons | 451/56 |
| 4,151,684 | 5/1979 | Wada et al. | 451/72 X |
| 4,182,082 | 1/1980 | Meyer | 451/56 X |
| 4,233,784 | 11/1980 | Loreto . | |
| 4,279,102 | 7/1981 | Hennenfent et al. | 451/53 |
| 4,587,763 | 5/1986 | Hahn | 451/53 X |
| 5,115,600 | 5/1992 | Kataoka et al. | 451/72 X |
| 5,291,693 | 3/1994 | Nguyen | 451/56 X |
| 5,645,682 | 7/1997 | Skrovan | 451/56 X |
| 5,779,522 | 7/1998 | Walker et al. | 451/56 |

FOREIGN PATENT DOCUMENTS

| | | |
|---|---|---|
| 0584578 | 7/1993 | European Pat. Off. . |
| 1502438 | 1/1964 | Germany . |
| 7202327 | 5/1972 | Germany . |
| 2067935 | 8/1981 | United Kingdom . |

*Primary Examiner*—Timothy V. Eley
*Attorney, Agent, or Firm*—Ostrolenk, Faber, Gerb & Soffen, LLP

[57] ABSTRACT

To increase the service life of a grinding wheel which is intended for grinding the borders of spectacle lenses, wherein the wheel comprises a core wheel, preferably made of plastic, and a ring made of sintered metal with embedded diamond particles, a method comprising treating the grinding surface at least occasionally by a fluid jet under high pressure to clean the surface and keep it sharp. The cooling fluid used during grinding may be the fluid in the jet. It may be fed at lower pressure while higher pressure may be occasionally supplied.

8 Claims, No Drawings

METHOD OF INCREASING THE SERVICE LIFE OF GRINDING WHEELS

BACKGROUND OF THE INVENTION

The invention relates to a method of increasing the service life of grinding wheels which are intended for grinding the borders or edges of spectacle lenses. Each wheel comprises a core wheel, preferably made of plastic, and a ring around the core made of sintered metal with embedded diamond particles.

A grinding wheel of this type is described in German Utility Model 72 02 327. The core wheel made of plastic is fastened on a grinding spindle by a hub bore. A ring attached to this core wheel consists of sintered bronze in which fine diamond particles are embedded. Grinding wheels of this type can be used to grind to shape the borders of spectacle lenses made of silicate glass and plastic to enable these lenses to fit into a selected spectacle frame. Usually, a grinding wheel of this type is also provided with a beveling groove in order for a ridge bevel to be formed on the ground-to-shape spectacle lens. The ridge bevel is used for retaining the spectacle lens in a groove of the spectacle frame.

Although known grinding wheels with a ring made of sintered metal and embedded diamond particles are comparatively costly, they have a long service life, provided the ring made of sintered metal and the core wheel made of plastic are produced from suitable materials and are subjected to stringent quality control. The grinding wheel undergoes non-uniform wear during grinding of spectacle lenses. Dressing and evening renders the grinding wheel usable again until the sintered metal ring has become so thin that any further use is no longer possible.

The dressing operation is necessary after approximately 5000 spectacle lenses made of silicate glass have been ground. Although the grinding wheel is evened again during the dressing, so much abrasive material has to be removed from the surface of the grinding wheel for dressing it that its service life is limited overall. To remedy this disadvantage, U.S. Pat. No. 4,233,784 proposes a grinding method which can supposedly be used to grind 25,000 or more spectacle lenses made of silicate glass. For this purpose, the grinding wheel is scanned before the grinding operation. The spectacle lens is then positioned on a region of the grinding wheel which is higher than adjacent regions. As a result, grinding of a spectacle lens always subjects the higher regions of the grinding wheel to wear, and a longer service life can be achieved overall without the grinding wheel having to be dressed. The control means used for this purpose do not increase the costs of the grinding machine to any significant extent.

German Offenlegungsschrift 1 502 438 discloses a grinding apparatus in which feeding of a flushing medium releases the particles which are embedded in the surface and flushes these particles out of the surface. In this case, the flushing medium is repeatedly deflected between the surfaces of the wheel and the baffle plate. As a result, that medium should repeatedly come into close contact with the surface of the wheel. This sufficiently cools the surface and the accumulated abraded material is released.

DESCRIPTION OF THE INVENTION

The object of the invention is to increase the service life of grinding wheels of the above type while avoiding need for frequent dressing of the wheel and avoiding the need for the grinding apparatus to be equipped with costly, additional equipment.

In a method of the type mentioned in the introduction, with the invention, the grinding surface may be treated at least occasionally by a fluid jet under a high pressure of at least 25 bar, and may thus be cleaned and kept sharp. The pressure of the fluid supplied to the wheel surface may preferably be more than 100 bar.

The invention is based on the discovery that the sharpness of the grinding surfaces of diamond grinding wheels decreases when the pores become clogged with abraded material. Decreasing sharpness of the grinding surface requires either that the grinding pressure or the grinding duration be increased in order to grind a given spectacle lens to shape. However, increased grinding pressure or increased grinding duration increases the wear to which the grinding surface is subjected, and this is also non-uniform. As a result, the grinding wheel has to be dressed and evened, which inevitably results in additional wear and thus in a reduction in its service life.

These disadvantages are avoided by the method according to the invention since cleaning by means of the fluid jet under high pressure means that the grinding surface remains sharp for a longer time and the grinding pressure or the grinding duration do not have to be increased over time. As a result, the wear to which the grinding surface is subjected is more uniform and the surface does not have to be dressed and evened so frequently.

The cooling fluid which is used for grinding may also be used for cleaning the grinding surface and for keeping it sharp. The cooling fluid may be unfiltered. As a result, the abraded material contained in the cooling fluid, and the likewise abraded diamond particles, effect intensive cleaning and thus keep the grinding surface sharp.

Treatment with the fluid jet under high pressure may preferably be provided during the grinding, avoiding the need for any additional time for cleaning the grinding surface and keeping it sharp. Treatment with the fluid jet under high pressure can be provided throughout the grinding operation.

Treatment with a fluid jet can also serve for feeding coolant to the wheel during the grinding operation. There may be no need for any further coolant feed. Since the coolant is atomized to a pronounced extent during treatment of the grinding surface, when the fluid is delivered in a jet under high pressure, a well sealed grinding chamber is nevertheless necessary. However, it is preferably also possible for the pressure of the fluid jet to be increased only occasionally for cleaning the grinding surface and keeping it sharp, and thus to achieve the effect desired according to the invention. During the remainder of the grinding operation, the pressure can be reduced when the fluid also serves for feeding the coolant, in order to reduce the energy consumption and to avoid pronounced atomization of the coolant throughout the grinding.

Despite the operations for cleaning the grinding surface and keeping it sharp by supplying the fluid jet under high pressure, if the grinding surface is subjected to non-uniform wear and is no longer sufficiently sharp, it may be dressed in the conventional manner by a dressing brick or by a rotatable dressing wheel which may be driven. Treatment with the fluid jet under high pressure takes place during the dressing operation for assisting this operation.

In a known manner, the dressing tool may comprise diamond, aluminum oxide or steel and may also serve for reshaping any beveling groove which may be present.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A method for extending the life of disks employed to grind the edges of eyeglass lenses, the disks comprising a core and a ring embedded with particles of diamond, the method comprising the steps of:

applying a coolant liquid to the surface of the disk at low pressure during a grinding operation of the disk; and intermittently increasing a pressure of the applied coolant liquid to at least 25 bars, whereby the surface of the disk is cleaned and its abrasiveness maintained.

2. The method as recited in claim 1, wherein the increased pressure of the coolant liquid is higher than 100 bars.

3. The method as recited in claim 2, wherein the liquid coolant is unfiltered.

4. The method as recited in claim 3, further comprising the step of:

dressing the grinding disk with a dressing block or with a rotating, optionally motor-powered, dressing wheel while the grinding disk is being subjected to the cooling liquid at the increased pressure.

5. The method as recited in claim 2, further comprising the step of:

dressing the grinding disk with a dressing block or with a rotating, optionally motor-powered, dressing wheel while the grinding disk is being subjected to the cooling liquid at the increased pressure.

6. The method as recited in claim 4, wherein the liquid coolant is unfiltered.

7. The method as recited in claim 6, further comprising the step of:

dressing the grinding disk with a dressing block or with a rotating, optionally motor-powered, dressing wheel while the grinding disk is being subjected to the cooling liquid at the increased pressure.

8. The method as recited in claim 1, further comprising the step of:

dressing the grinding disk with a dressing block or with a rotating, optionally motor-powered, dressing wheel while the grinding disk is being subjected to the cooling liquid at the increased pressure.

* * * * *